US009418522B2

(12) United States Patent
Pizzato et al.

(10) Patent No.: US 9,418,522 B2
(45) Date of Patent: Aug. 16, 2016

(54) ELECTRONIC HINGED SAFETY SWITCH

(71) Applicant: PIZZATO ELETTRICA SRL, Marostica (IT)

(72) Inventors: Marco Pizzato, Marostica (IT); Giuseppe Pizzato, Marostica (IT)

(73) Assignee: PIZZATO ELETTRICA S.R.L., Marostica (VI) (IT)

( * ) Notice: Subject to any disclaimer, the term of this patent is extended or adjusted under 35 U.S.C. 154(b) by 131 days.

(21) Appl. No.: 14/378,804

(22) PCT Filed: Dec. 23, 2013

(86) PCT No.: PCT/IB2013/061271

§ 371 (c)(1),
(2) Date: Aug. 14, 2014

(87) PCT Pub. No.: WO2014/102705

PCT Pub. Date: Jul. 3, 2014

(65) Prior Publication Data

US 2015/0029033 A1 Jan. 29, 2015

(30) Foreign Application Priority Data

Dec. 28, 2012 (IT) ..... VI2012A0345

(51) Int. Cl.

| | |
|---|---|
| ***G08B 21/00*** | (2006.01) |
| ***G08B 5/36*** | (2006.01) |
| ***H01H 3/16*** | (2006.01) |
| ***E05D 11/00*** | (2006.01) |
| *H01H 3/42* | (2006.01) |

(52) U.S. Cl.

CPC ..... *G08B 5/36* (2013.01); *E05D 11/0081* (2013.01); *H01H 3/162* (2013.01); *H01H 3/42* (2013.01)

(58) Field of Classification Search

CPC ..... G08B 5/36
USPC ..... 340/815.4, 815.45, 540, 545.1, 693.5
See application file for complete search history.

(56) References Cited

U.S. PATENT DOCUMENTS

| | | | |
|---|---|---|---|
| 4,845,772 | A | 7/1989 | Metroka |
| 6,373,006 | B1 | 4/2002 | Toki |

FOREIGN PATENT DOCUMENTS

| | | |
|---|---|---|
| GB | 2150757 | 7/1985 |

*Primary Examiner* — Jeffery Hofsass
(74) *Attorney, Agent, or Firm* — Themis Law

(57) ABSTRACT

An electronic hinged safety switch adapted for installation on protection barriers (B) of machines and/or automatic plants having one or more electric safety circuits (S). The switch comprises a substantially box-like fixed member (2) designed to be secured to a stationary part (M) of a protection barrier (B) and a movable member (3) designed to be secured to a pivotal part (P) of the protection barrier (B) and coupled to the fixed member (2) through hinge means (4). Sensing means (5) are housed in said box-like fixed member (2) for interacting with the hinge means (4) to send an electric control signal ($S_C$) to one or more electric safety circuits (S) at a predetermined switching angle ($\alpha$). The sensing means (5) comprise at least one sensor for generating a corresponding actuation signal ($S_A$) at the switching angle ($\alpha$), and an electronic control unit (8) operatively connected to at least one sensor (6). The electronic control unit (8) has at least one input (9) electrically connected to said sensor (6) for receiving the actuation signal ($S_A$) and at least one output (10) connected to the electronic safety circuits (S) for generating the electric control signal ($S_C$) in response to the actuation signal ($S_A$).

14 Claims, 4 Drawing Sheets

ELECTRONIC HINGED SAFETY SWITCH

FIELD OF THE INVENTION

The present invention generally finds application in the field of electric safety devices and particularly relates to an electronic hinged safety device.

BACKGROUND ART

Hinged safety switches are known to be used in plants or machines having areas or rooms bounded by protection barriers, and containing mechanical moving members or hazardous devices.

Particularly, these safety switches are mounted to a protection barrier having a fixed part integral with the machine or plant, and a movable panel designed to be opened by an operator.

Hinged safety switches have casing designed to be secured to the fixed part of the barrier and a movable part, which can pivot relative to the enclosure, and is designed to be secured to the panel.

Furthermore, the switch comprises an electrical commutator and an actuator, which is adapted to interact with such commutator upon pivotal movement of the movable part.

As the panel is opened and/or closed, the movable part of the switch is caused to pivot relative to the casing and the actuator is triggered.

This latter will thus actuate the commutator to cause one or more electric safety circuits associated with the barrier to open and/or close.

A very common type of hinged safety switches uses mechanical commutators.

IT1362135, filed by the applicant hereof, discloses a safety switch with a mechanical commutator housed within the casing. This commutator comprises one or more movable contacts, moving along a longitudinal axis, whose displacement is driven by an actuator which is adapted to convert the rotary motion of the movable part into an axial translational motion.

Furthermore, this prior art switch may comprise LED-type optical signaling means, for confirming proper operation of the contacts and indicating where actuation occurs.

A first drawback of this prior art arrangement is that the use of mechanical commutators does not easily allow generation of electric signals with additional information concerning the position of the barrier or the state of the switch.

This is because mechanical commutators only allow switching of electrical contacts associated with safety circuits and cannot determine any inconsistent switching states of the contacts or wiring or contact unit failures.

A further drawback of this arrangement is that switches with mechanical commutators cannot be easily installed in safety plants that use a data bus or a field bus connected to an electronic control unit.

The installation of hinged safety devices with analog contact units requires an appropriate analog-to-digital conversion interface, such as AS-i or the like, to be interposed between the bus and the contacts, which will increase installation costs and circuit complexity of the electrical system.

DISCLOSURE OF THE INVENTION

The object of the present invention is to overcome the above drawbacks, by providing an electronic hinged safety switch that is highly efficient and relatively cost-effective.

A particular object of the present invention is to provide an electronic hinged safety switch that allows generation of one or more additional electric signals concerning switch operation.

Another object of the present invention is to provide an electronic hinged safety switch designed for connection to a digital communication system of the bus type or the like.

A further object of the present invention is to provide an electronic hinged safety switch that affords very quick and fully automatic enabling and/or disabling thereof by the plant during maintenance.

These and other objects, as better explained hereafter, are fulfilled by an electronic hinged safety switch as defined in claim 1.

Advantageous embodiments of the invention are obtained in accordance with the dependent claims.

BRIEF DESCRIPTION OF THE DRAWINGS

Further features and advantages of the invention will be more apparent upon reading of the detailed description of a preferred, non-exclusive embodiment of an electronic hinged safety switch according to the invention, which is described as a non-limiting example with the help of the annexed drawings, in which.

DETAILED DESCRIPTION OF A PREFERRED EMBODIMENT

Referring to the above mentioned figures, a multifunctional electronic hinged safety switch, generally designated by numeral 1, is adapted for use in a protection barrier B which is designed to bound a hazardous area of a machine or a plant.

Figure 1:
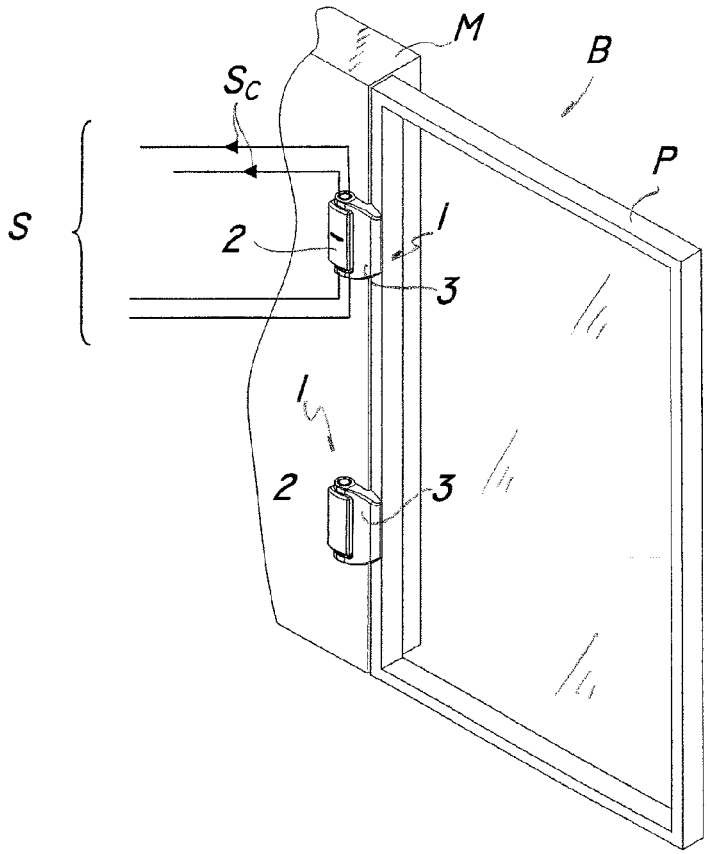
FIG. 1 is a perspective view of a protection barrier comprising a hinged switch of the invention.

Particularly, as best shown in FIG. 1, the protection barrier B may comprise a stationary part M which is designed to be secured to the ground or the frame of the machine or plant, and a pivotal part P, such as a door or over hinged to the stationary part M.

Furthermore, the barrier B is equipped with one or more electric safety circuits S for signaling that the door D has been opened and/or closed, by varying an appropriate electric signal.

Figure 2:
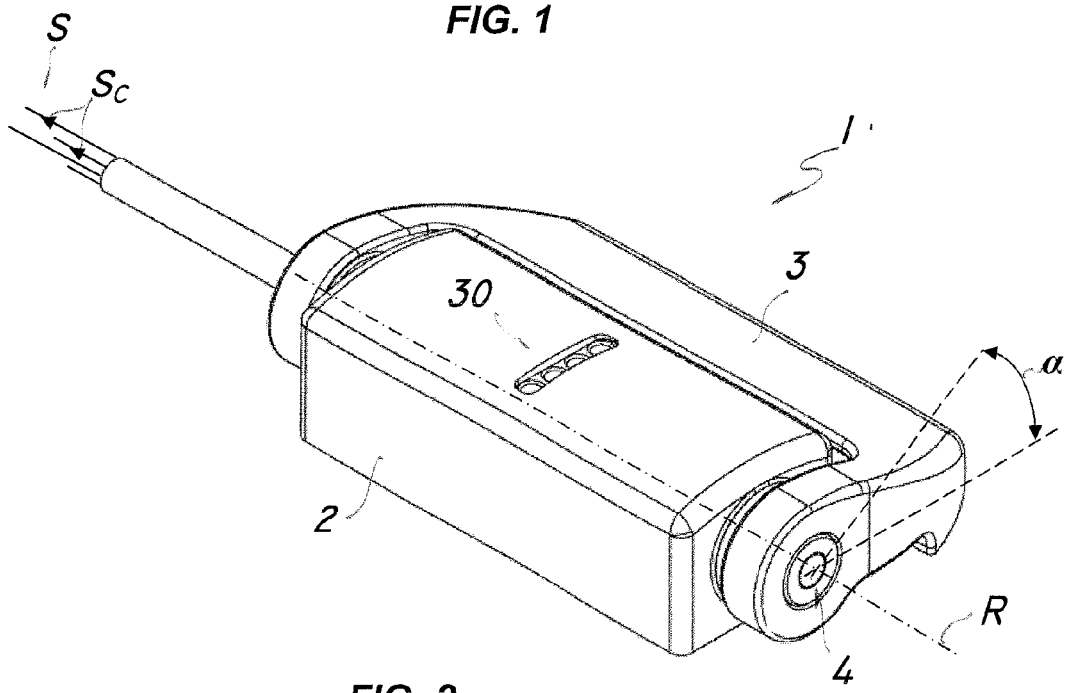
FIG. 2 is a perspective view of the switch of FIG. 1.

The multifunctional hinged switch 1 of the invention comprises, as best shown in FIG. 2, a substantially box-like fixed member 2 designed to be secured to a stationary part M of the protection barrier B and a movable member 3 designed to be secured to a pivotal part P of the barrier B and to be coupled to the fixed member 2 through hinge means 4.

The switch 1 further comprises sensing means 5 located in the fixed member 2 and interacting with the hinge means 4 to send an electric control signal $S_C$ to one or more electric safety circuits S at an adjustable switching angle $\alpha$.

The switch 1 may comprise a pair of electric inputs and a pair of electric outputs, not shown, for connection of at least one safety circuit S.

According to a peculiar feature of the invention, the sensing means 5 comprise at least one sensor 6 for generating a corresponding actuation signal $S_A$ at the switching angle $\alpha$.

Furthermore, the sensing means 5 comprise an electronic control unit 8 operatively connected to a sensor 6 and having at least one input 9 electrically connected to the sensor 6 for receiving the actuation signal $S_A$ and at least one output 10 connected to the electric safety circuits S for generating the electric control signal $S_C$ in response to such actuation signal $S_A$.

Conveniently, the actuation signal may have electric parameters, such as voltage, current or frequency, that are selectively variable according to the number of switching commutations by the sensor 6.

Particularly, the electronic control unit 8 may be designed to cause the sensor 6 to be switched upon detection of a voltage applied to the input and/or an electric current circulating through the contacts.

Furthermore, the sensor 6 may generate a single actuation signal $S_A$.

Alternatively, the sensor 6 may comprise a plurality of electric and/or electronic contact units associated with the door P of the barrier B, each adapted to generate a corresponding assessment signal $s_a$.

In this case, the actuation signal $S_A$ comprises the plurality of assessment signals $s_a$ generated by respective electric and/or electronic contact units in the sensor 6.

Furthermore, the actuation signals $s_A$ may have first and second levels, associated with the open and closed states of the door P of the protection barrier B respectively.

Conveniently, the sensor 6 may be selected from the group comprising mechanical commutators and/or electronic sensors.

Figure 3:
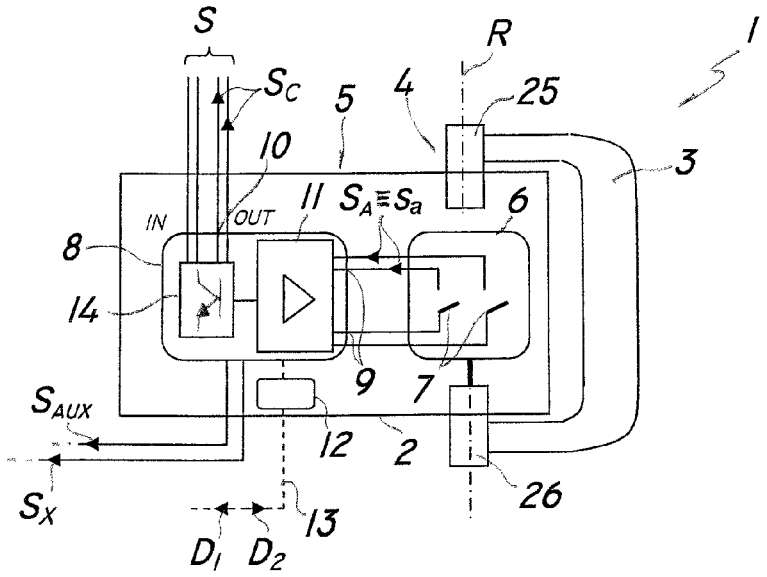
FIG. 3 is a wiring block diagram of the switch of FIG. 1.
Figure 4:
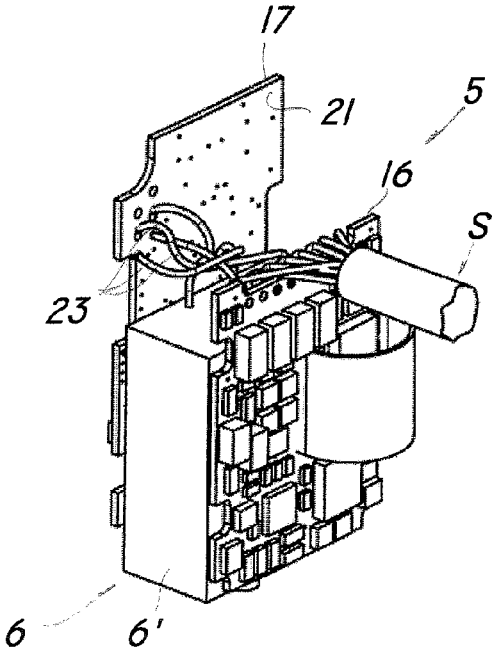
FIG. 4 is a perspective view of a first detail of the switch of FIG. 1.
Figure 5:
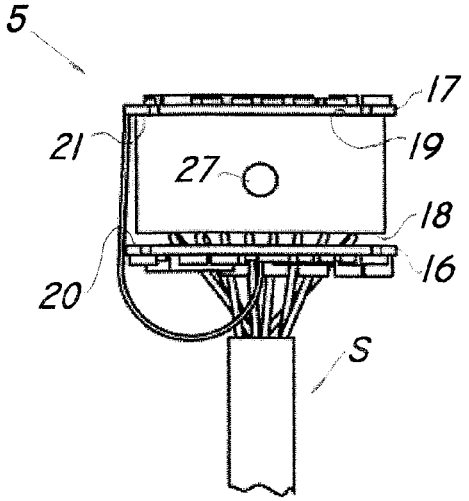
FIG. 5 is a top view of the detail of FIG. 4.
Figure 6:
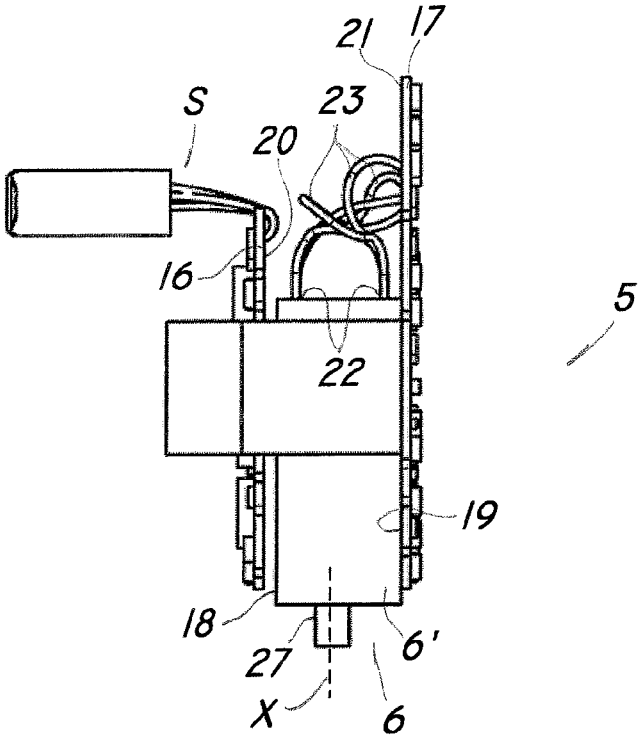
FIG. 6 is a first side view of the detail of FIG. 4.
Figure 7:
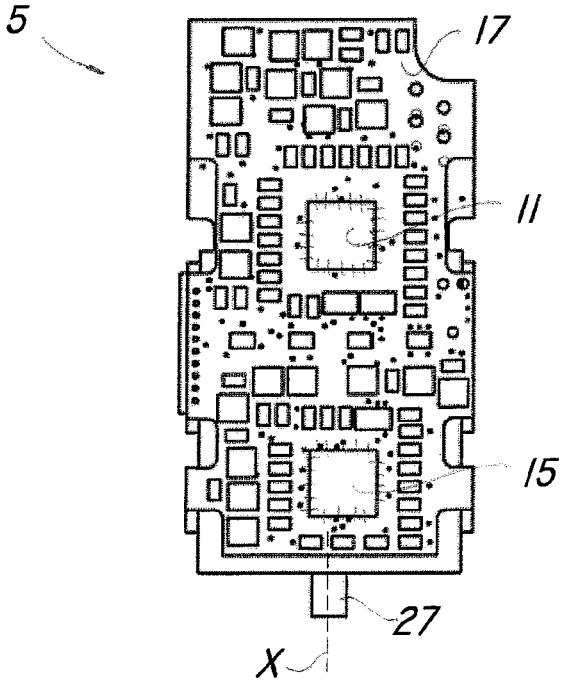
FIG. 7 is a second side view of the detail of FIG. 4.

The electronic control unit 8, as best shown in the diagram of FIG. 3, may comprise first microprocessor means 11 for receiving the actuation signal $S_A$ at the input 9.

The first microprocessor means 11 may be designed to process the actuation signal $S_A$ and generate the control signal $S_C$ to be provided at the output 10.

The control signal $S_C$ generated by the first microprocessor means 11 may be of analog or digital type, according to the type of electric safety circuits S associated with the barrier B.

Particularly, the electric safety circuits S may comprise a central unit, not shown, for detecting the open and/or closed states of the doors P of a plurality of protection barriers B by detecting a control signal $S_C$ of digital type.

Conveniently, the control signal $S_C$ may be null when an actuation signal $S_A$ corresponding to the open state of the door P of the barrier B is present at the input 9.

Otherwise, the control signal $S_C$ may be other than zero when an actuation signal $S_A$ corresponding to the closed state of the door P of the barrier B is present at the input 9.

Advantageously, the control signal may be other than zero, when the totality of the assessment signals $s_A$ perform a passage from the first level to the second level.

Conveniently, as best schematically shown in FIG. 3, the sensor may comprise electric contacts 7.

Particularly, the electronic control unit 8 may be adapted to generate a control signal other than zero, when the contacts 7 are switched from a state in which they are all open to a state in which they are all closed.

Conveniently, the electronic control unit 8 may be designed to generate an alarm signal $S_X$ for indicating the presence of assessment signals $s_A$ at different levels.

In this case the alarm signal $S_X$ allows simultaneous signaling of the electric inconsistency state associated with a sensor 6 in the switch 1.

Conveniently, the electronic control unit 8 may comprise interface means 12 connected to the first microprocessor means 11 and to an external communication line 13 associated with one or more additional electric devices, not shown.

The external communication line 13 may be as used in common communication systems for electric safety plants and may comprise, for instance, a data bus or a field bus of the AS-i or AS-i Safe type.

Conveniently, the interface means 12 may transmit first data $D_1$ associated with the actuation signal $S_A$ and/or the control signal $S_C$ into the external communication line.

Furthermore, the interface means 12 may be designed to receive second data $D_2$ associated with the additional electric safety devices from the external communication line 13.

Particularly, the first microprocessor means 11 may be designed to generate the control signal $S_C$ in response both to the activation signal $S_A$ and to the second data $D_2$ received from the interface means 12.

Thus, the switch 1 may be installed in a cascade of interconnected safety devices, and the control signal $S_C$ generated thereby may be influenced by the electric state of the contacts in the additional safety devices.

The first microprocessor means 11 may comprise a non-volatile memory medium (ROM), not shown, in which permanent data are stored, and a volatile memory medium (RAM), also not shown, in which temporary data are stored.

The first microprocessor means 11 may be designed to perform periodic operation checks on the non-volatile memory medium (ROM) and the volatile memory medium (RAM).

Such configuration of the first microprocessor means 11 allows the provision of a switch 1 that can meet current standards concerning totally or partially electronic safety devices.

Conveniently, the first microprocessor means 11 may be programmed for periodically starting a check-up on the sensors 6, the input 9 and the output 10.

Particularly, as best shown in the diagram of FIG. 3, the electronic control unit 8 may comprise one or more transistors 14 controlled by the first microprocessor means 11 and operatively connected to the output 10.

Each transistor 14 may comprise a biasing circuit, not shown, which is designed to allow it to operate as a switch by the action of the first microprocessor means 11, in ON/OFF mode.

The on/off operation of the transistor 14 will modify the control signal $S_C$ sent to the electric safety circuit S and generated by the first processing means 11.

Conveniently, the first microprocessor means 11 may be designed for periodically checking proper ON/OFF transition of each transistor 14 and, as a result, proper electrical operation of the output 10.

Furthermore, the first microprocessor means 11 may be adapted to generate an auxiliary electric signal $S_{aux}$ corresponding to the number of switching instances of the sensor 6.

Particularly, the first microprocessor means 11 may be adapted to detect the overall number of switching instances by the sensor 6 within a predetermined time interval.

For example, the first microprocessor means 11 may be adapted to generate an auxiliary signal $S_{aux}$, when the switch 1 reaches a total operating time equal to a predetermined factory-preset value.

Advantageously, the electrical control unit 8 may comprise second microprocessor means 15 which interact with the first microprocessor means 11 to process the actuation signal $S_A$ and generate the control signal $S_C$.

Furthermore, the second microprocessor means 15 may be substantially symmetrical to the first microprocessor means 11 for redundant processing of the actuation signal $S_A$.

Thus, the second microprocessor means 15 may be designed to only actuate the generation of the control signal $S_C$ by the first microprocessor means 11 when such redundant processing provides results consistent with those obtained from processing by the first microprocessor means 11.

The electronic control unit 8 may comprise power supply means, not shown, for supplying power to the first 11 and second 15 microprocessor means 15, the interface means 12 and the transistors 14.

Conveniently, as best shown in FIGS. 4 to 7, the electronic control unit 8 may comprise a pair of rigid supports 16, 17 for supporting and connecting together at least the first 11 and second 15 microprocessor means, the interface means 12 and the transistors 14.

For example, each rigid support 16, 17 may be a printed circuit board PCB or the like.

Furthermore, as best shown in the illustrated configuration of the invention, the sensor 6 may be interposed between the rigid supports 16, 17 and may comprise a pair of substantially flat side walls 18, 19, which are adapted to contact respective bottom walls 20, 21 of the rigid supports 16, 17.

Conveniently, the sensor 6 may have output terminals 22 connected to the inputs 9 of the electronic processing unit 8 via corresponding interconnection cables 23.

Figure 8:
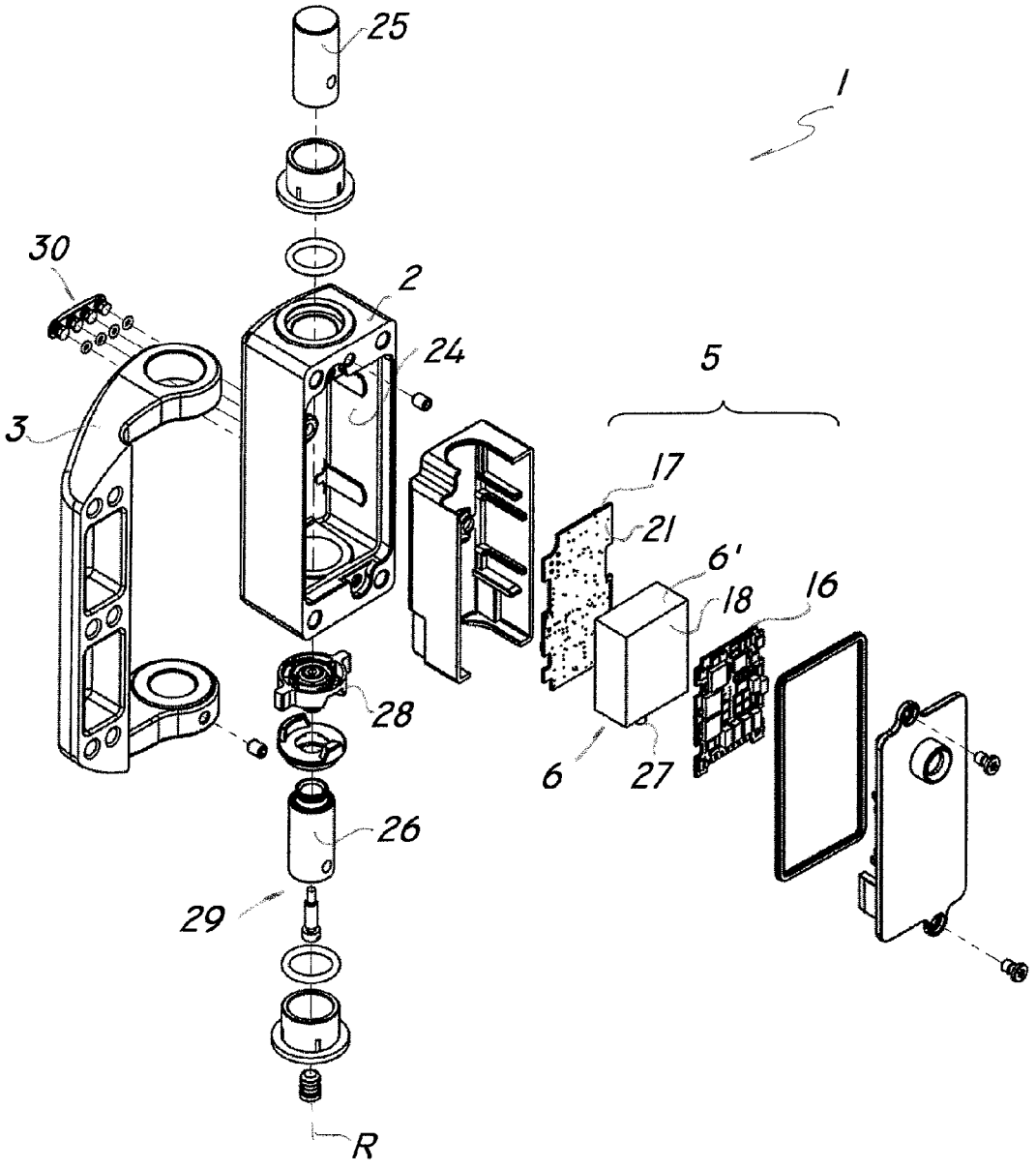
FIG. 8 is an exploded perspective view of the switch of FIG. 2.

The fixed member 2, as best shown in FIG. 8, comprises a compartment 24, which is adapted to accommodate therein the sensor 6 and the electronic control unit 8.

Furthermore, the hinge means 4 may comprise a pair of pins 25, 26 associated with the movable member 3 and pivoted to the fixed member 2.

The pins 25, 26 allow the movable member 3 to pivot relative to the fixed member 2 about a common axis of rotation R.

According to a particular configuration of the invention, as shown in the figures, the sensor 6 may be a microswitch 6' with mechanical contacts, and may comprise electric contacts 7 for generating respective assessment signals $s_a$.

The number of the electric contacts 7 of the microswitch 6' may depend on the number of connections in the safety circuits S.

Also, the microswitch 6' may be designed to cause switching of the contacts 7 either at the same switching angle $\alpha$ or at different switching angles $\alpha$.

The microswitch 6' may be designed to interact with at least one of the pins 25, 26.

Furthermore, the microswitch 6' may comprise a slider 27, which is designed for translation in a direction X parallel to the common axis of rotation R, and is adapted to cause the contacts 7 to open and/or close.

Conveniently, the microswitch 6' may comprise at least one actuator element 28, operatively connected to one of the pins 25, 26, and interacting with the slider 27.

The actuator element 28 may be designed to provide conversion of the rotary motion of the pin 25, 26, into an axial motion of the slider 27.

Furthermore, the switch 1 may comprise adjustment means 29 for adjusting the switching angle $\alpha$ of the contacts 7 associated with at least one of the pins 25, 26.

For example the adjustment means 29 may be as disclosed in the Italian patent IT1362135, issued to the applicant hereof.

Conveniently, the switch 1 may comprise LED signaling means 30, as shown in FIGS. 2 and 8, associated with the fixed member 2.

The first microprocessor means 11 may be adapted to selectively power the signaling means 30 for generating differentiated light signals according to the actuation signal $S_A$ and/or the control signal $S_C$.

Particularly, the signaling means 30 may comprise three or more LEDs for emitting a light signal associated with the electrical function of the input 9, the output 10 and the sensor 6.

Thus, an operator may easily monitor the operating state of the switch 1 by watching at the differentiated light signals emitted by the signaling means 30.

The above disclosure clearly shows that the invention fulfills the intended objects and particularly provides a remarkably safe and versatile multifunctional hinged switch.

The multifunctional hinged switch of this invention is susceptible to a number of changes and variants, within the inventive principle disclosed in the appended claims. All the details thereof may be replaced by other technically equivalent parts, and the materials may vary depending on different needs, without departure from the scope of the invention.

While the multifunctional hinged switch has been described with particular reference to the accompanying figures, the numerals are only used for the sake of a better intelligibility of the invention and shall not be intended to limit the claimed scope in any manner.

The invention claimed is:

1. An electronic hinged safety switch combined with a protection barrier (B) of machines or automatic plants comprising:

a protection barrier (B) designed to bound a hazardous area of a machine or plant, said protection barrier (B) having a stationary part (M), designed to be secured to a ground or to a frame of said machine or plant, and a pivotal part (P), hinged to said stationary part (M);

a switch (1) having a substantially box-shaped fixed member (2), designed to be secured to said stationary part (M) of the protection barrier (B), and a movable member (3), designed to be secured to said pivotal part (P) of the protection barrier (B);

wherein said protection barrier (B) has one or more electric safety circuits (S) signaling that a door (D) has been opened and/or closed;

wherein said switch (1) comprises a hinge (4) pivotally coupling said movable member (3) to said box-shaped fixed member; and a sensing unit (5) housed in said box-shaped fixed member (2) and interacting with said hinge (4) to send an electric control signal ($S_C$) to one or more electric safety circuits (S) at a predetermined switching angle ($\alpha$);

wherein said fixed member (2) has an inner compartment (24) housing said sensing unit (5); and wherein said sensing unit (5) comprises, at least one sensor (6) for generating a corresponding actuation signal ($S_A$) at said switching angle ($\alpha$), and n electronic control unit (8) operatively connected to said at least one sensor (6), said electronic control unit (8) having at least one input (9) electrically connected to said sensor (6) for receiving said actuation signal ($S_A$) and at least one output (10) connected to said one or more electric safety circuits (S) for generating said electric control signal ($S_C$) in response to said actuation signal ($S_A$), said electronic control unit (8) being housed in said inner compartment (24).

2. The electronic hinged safety switch combined with a protection barrier as claimed in claim 1, wherein said at least one sensor (6) is selected from the group consisting of mechanical commutators and electronic commutators.

3. The electronic hinged safety switch combined with a protection barrier as claimed in claim 1, wherein said electronic control unit (8) comprises a first microprocessor (11) receiving said actuation signal ($S_A$) through said at least one input (9) and processing said actuation signal ($S_A$) to generate said control signal ($S_C$).

4. The electronic hinged safety switch combined with a protection barrier as claimed in claim 3, wherein said first microprocessor (11) is adapted to generate a null or non-zero control signal ($S_C$), when said at least one input (9) has therein an actuation signal ($S_A$) generated by an open state or closed state respectively of the pivotal part (P) of the protection barrier (B).

5. The electronic hinged safety switch combined with a protection barrier as claimed in claim 4, wherein said actuation signal ($S_A$) comprises a plurality of electric assessment signals ($s_a$), each having a first level associated with the open state of the pivotal part (P) of the protection barrier (B) and a second level associated with the closed state of the pivotal part (P), said control signal ($S_C$) being other than zero when a totality of said electric assessment signals perform ($S_A$) a transaction from said first level to said second level.

6. The electronic hinged safety switch combined with a protection barrier as claimed in claim 3, wherein said electronic control unit (8) comprises an interface (12) connected to said first microprocessor (11) and to an external communication line (13) associated with one or more additional electric devices.

7. The electronic hinged safety switch combined with a protection barrier as claimed in claim 6, wherein said interface (12) is adapted to transmit first data ($D_1$) associated with said actuation signal ($S_A$) and/or said control signal ($S_C$) into said external communication line (13), and to receive second data ($D_2$) associated with one or more additional electric safety devices from said external communication line (13).

8. The electronic hinged safety switch combined with a protection barrier as claimed in claim 3, wherein said first microprocessor (11) comprises a non-volatile memory medium (ROM) in which permanent data is stored, and a volatile memory medium (RAM) in which temporary data is stored, said first microprocessor (11) being designed to perform periodic operation checks on said non-volatile memory medium (ROM) and said volatile memory medium (RAM).

9. The electronic hinged safety switch combined with a protection barrier as claimed in claim 3, wherein said first microprocessor (11) are programmed for periodically starting a check-up on said at least one sensor (6), said at least one input (9) and said at least one output (10).

10. The electronic hinged safety switch combined with a protection barrier as claimed in claim 9, wherein said first microprocessor (11) is adapted to generate an auxiliary signal ($S_{aux}$) corresponding to an overall number of switching instances by said at least one sensor (6) in a predetermined time.

11. The electronic hinged safety switch combined with a protection barrier as claimed in claim 3, wherein said electronic control unit (8) comprises a second microprocessor (15) which interacts with said first microprocessor (11) for processing said actuation signal ($S_A$) and generating said control signal ($S_C$).

12. The electronic hinged safety switch combined with a protection barrier as claimed in claim 3, further comprising a signaling unit (30) associated with said fixed member (2), said first microprocessor (11) being adapted to selectively power said signaling unit (30) to generate differentiated light signals according to said actuation signal ($S_A$) and/or said control signal ($S_C$).

13. The electronic hinged safety switch combined with a protection barrier as claimed in claim 12, wherein said signaling unit (30) comprises one or more LEDs, which are adapted to emit light signals associated with an electrical function of inputs of the safety circuits (S), of said at least one output (10) and said at least one sensor (6) respectively.

14. The electronic hinged safety switch combined with a protection barrier as claimed in claim 1, wherein said hinge comprises a pair of pins (25, 26) associated with said movable member (3) and pivoted to said fixed member (2), said sensor (6) being adapted to interact with at least one of said pins (25, 26).

* * * * *